US005615537A

United States Patent [19]

Vollenweider

[11] Patent Number: 5,615,537

[45] Date of Patent: Apr. 1, 1997

[54] METHOD AND MEANS FOR PACKING PRINTED PRODUCTS

[75] Inventor: Jürg Vollenweider, Fehraltdorf, Switzerland

[73] Assignee: Ferag AG, Hinwil, Switzerland

[21] Appl. No.: 415,134

[22] Filed: Mar. 30, 1995

[30] Foreign Application Priority Data

Apr. 8, 1994 [CH] Switzerland ..... 01041/94

[51] Int. Cl.[6] ..... B65B 11/30

[52] U.S. Cl. ..... 53/466; 53/206; 53/234; 53/429; 53/460

[58] Field of Search ..... 53/461, 466, 460, 53/206, 234, 225, 399, 429, 233, 232, 228, 582, 569

[56] References Cited

U.S. PATENT DOCUMENTS

| | | | |
|---|---|---|---|
| 3,951,399 | 4/1976 | Reist | 270/58 |
| 4,021,993 | 5/1977 | Widmer | 53/234 X |
| 4,038,893 | 8/1977 | Reist | 83/159 |
| 4,058,202 | 11/1977 | Reist et al. | 198/482 |
| 4,398,710 | 8/1983 | Hänsch | 270/55 |
| 4,408,439 | 10/1983 | Anderson | 53/466 X |
| 4,420,146 | 12/1983 | Reist | 270/55 |
| 4,743,005 | 5/1988 | Reist | 270/55 |
| 4,801,132 | 1/1989 | Reist | 270/55 |
| 4,981,291 | 1/1991 | Honegger et al. | 270/55 |
| 4,991,376 | 2/1991 | Backman | 53/466 X |
| 5,104,108 | 4/1992 | Honegger | 270/55 |
| 5,113,731 | 5/1992 | Reist | 83/35 |
| 5,169,139 | 12/1992 | Stauber et al. | 271/204 |

FOREIGN PATENT DOCUMENTS

| | | |
|---|---|---|
| 540816 | 10/1973 | Switzerland . |
| 668216 | 12/1988 | Switzerland . |

*Primary Examiner*—James F. Coan
*Attorney, Agent, or Firm*—Spencer & Frank

[57] ABSTRACT

A method and a device for packing continuously conveyed printed products being conveyed one of individually and in groups by enveloping a product insert with a packing element. The product insert includes one of a single product, a plurality of products supplied in succession and a group of products. A plurality of substantially V-shaped insertion compartments being continuously conveyed in a compartment conveying direction along a closed conveying path are provided, together with a plurality of prefolded packing elements each having a fold in a substantially continuously conveyed stream of packing elements. A respective packing element is successively introduced into each insertion compartment such that the fold of the respective packing element is introduced into a corresponding insertion compartment first. It is then ensured that each respective packing element is in an open position thereby providing open packing elements. Thereafter, a product insert is inserted into each open packing element. Each open packing element is then closed at least partially over its corresponding product insert thereby providing enveloped products, and each closed enveloped product is removed from its corresponding insertion compartment.

24 Claims, 6 Drawing Sheets

FIG. 8
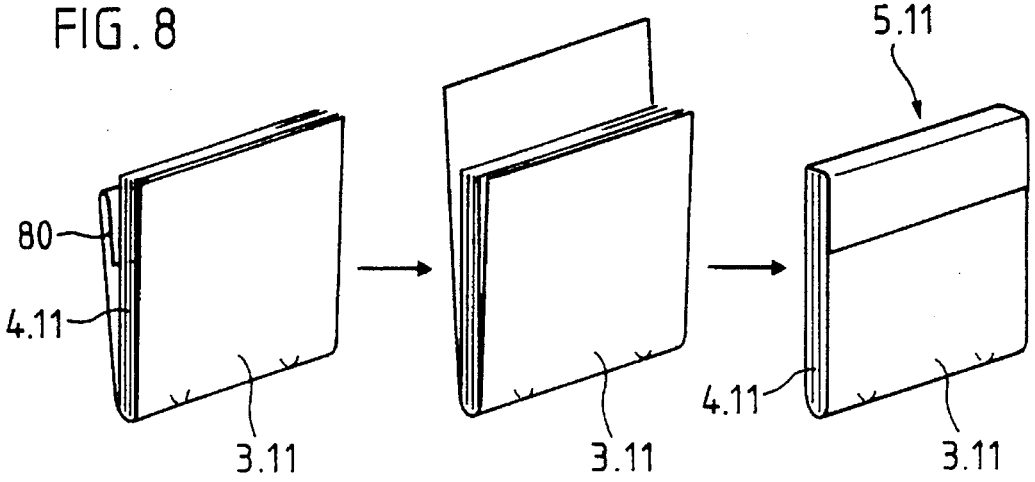
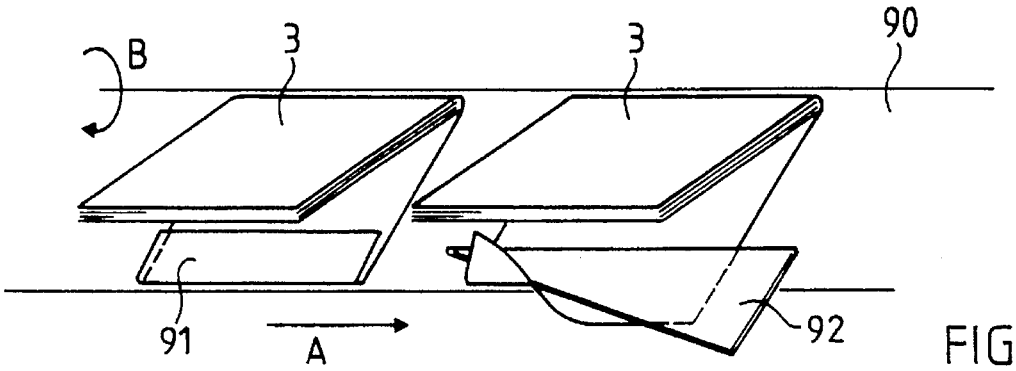
FIG. 9
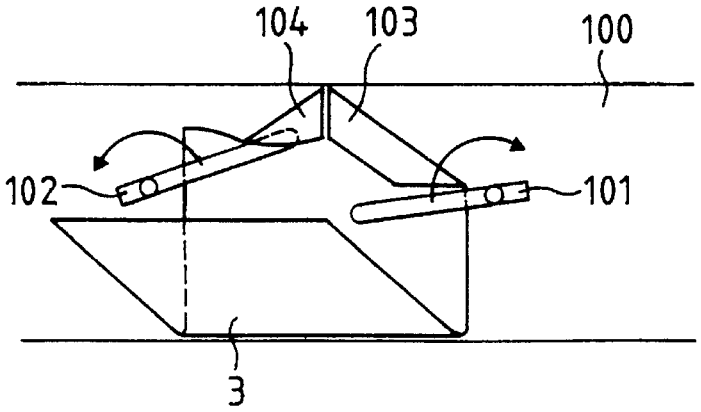
FIG. 10

METHOD AND MEANS FOR PACKING PRINTED PRODUCTS

FIELD OF THE INVENTION

The invention relates to a method and a means for packing continuously conveyed printed products, such as e.g. newspapers, periodicals or brochures, in each case one printed product or a small number of printed products being packed.

BACKGROUND OF THE INVENTION

Individual or several printed products, e.g. small groups of printed products, are, according to the prior art, packed for dispatch purposes, in that in a more or less continuous method they are enveloped with a wrapper, which is generally narrower than a printed product, but can also be of the same width as the latter. The printed products may, for the above purpose, be enveloped generally on all sides with a sheet which is e.g. welded, or they may be inserted in envelopes.

Different packing methods differ as a function of the nature of the pack to be used and therefore as a function of the effective protection offered by the pack to the printed product. Generally, a more complex method leads to a pack offering a better protection.

It is common among all the known methods that the products have to be individualized or singled and in part must even be stopped, i.e. the printed products must be supplied in a flow, in which they are e.g. conveyed parallel to a pair of edges such that the distance between the corresponding edges at right angles to the conveying direction of two adjacent products is at least as large as the extension of the products in the conveying direction. Such flows permit capacities of 8,000 to 12,000 copies per hour, but do not make it possible to achieve the presently required large capacities of up to 40,000 copies per hour. In order to achieve such a high capacity with the known methods, they would have to be performed in plurality and in parallel, which would lead to a correspondingly high apparatus expenditure.

SUMMARY OF THE INVENTION

The object of the invention is to provide a packing method for individual printed products or small groups of printed products, which method is applicable for producing a large variety of packs and which method can be performed in a high capacity flow without individualizing the products, i.e. in a flow in which the products are usually conveyed substantially transversely to their edges and with spacings which are significantly shorter than their edge lengths. Another object of the invention is to provide a means for performing the method, which is intended to have a maximum number of components for the further processing of the printed products and which should be designed in such a way that it can easily be adapted to different variants of the packing method. The method is applicable for products being conveyed continuously (that is, without being stopped) in a high capacity stream.

The object is achieved by the packing method and the means for performing the method according to the invention.

The fundamental idea of the method according to the invention is to adapt the insertion method as a packing method. For this purpose a curved or prefolded packing element is introduced with the curve or fold facing forward into a substantially V-shaped, continuously conveyed insertion compartment. In its curved or folded state the packing element, at least in one direction, is larger than the printed product to be packed. The packing element is then opened (the two V-shaped parts are separated from one another) and the product to be packed is "inserted" in the curved or prefolded packing element. The packing element is then at least partly closed, whilst still being located in the insertion compartment, in that e.g. parts of the packing element projecting beyond the product to be packed are placed over its edge and e.g. stuck to the opposite side. The printed product at least partly enclosed by the packing element is then removed from the insertion compartment. In the same way it is possible to insert together or successively in a single packing element a plurality of printed products and for the printed products to be packed in the described manner as printed product groups.

BRIEF DESCRIPTION OF THE DRAWINGS

Exemplified variants of the method according to the invention and exemplified embodiments of the means or device for performing the method are described in greater detail hereinafter relative to the attached drawings, wherein:

FIG. 8 is a view similar to FIG. 3 showing yet another embodiment of the method according to the invention.

FIG. 9 is a perspective view of a means for unfolding a folded-in part of a packing element in an insertion compartment having internal conveying means.

FIG. 10 is a perspective view of a means for unfolding a folded-in part of a packing element in an insertion compartment without internal conveying means.

DETAILED DESCRIPTION OF THE INVENTION

Figure 1:
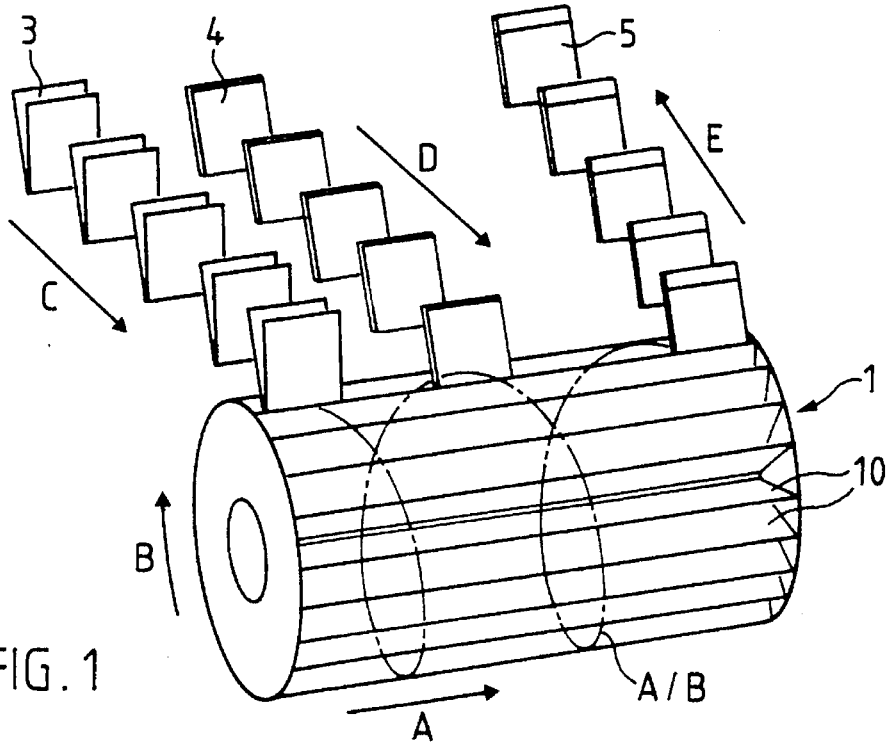
FIG. 1 shows a perspective view of a drum for packing printed products according to the invention.

For illustrating the method and means according to the invention, FIG. 1 very diagrammatically shows a packing drum 1, as is described in its function as an insertion drum e.g. in German patent 2447336, or in the corresponding U.S. Pat. No. 3,951,399. With such a drum, which functions as a packing drum in a manner to be described hereinafter, it is possible to perform the packing method according to the invention.

The packing drum is rotated about its rotation axis (arrow B). Around its circumference it has a plurality of insertion compartments 10, which extend in the radial direction of the drum, i.e. transversely to the rotation axis B thereof and which are equipped with conveying means for conveying (arrow A) a compartment content in the axial direction. The insertion compartments also have means for performing the individual method steps and/or such means are so positioned in the vicinity of the drum circumference that the insertion compartments are successively moved past the same by rotating the drum. The insertion compartments also contain retaining means with which a compartment content is kept in the compartment at least on the underside of the drum.

The conveying means in the insertion compartments, the means for performing the method steps and the retaining means are not shown in the drawing. Conveying means for conveying a compartment content (compartment-internal conveying means) are e.g. described in Swiss patent 575303 (or U.S. Pat. No. 4,058,202).

In the drum entrance area (start of arrow A, to the left in the drawing) the drum is supplied in a continuous flow (arrow C), e.g. a high capacity flow, of folded or at least curved or bent packing elements 3 in such a way that one packing element is placed in each insertion compartment and namely with the fold or curve first, that is, facing forward, so that the latter comes to rest against the bottom of the V-shaped compartment.

The packing elements placed in the insertion compartments are now moved in a circular manner by the rotation of the drum and in the axial direction by the conveying means in the compartments, so that a spiral movement path is obtained. As a function of the internal conveying means the movement path can have a smooth spiral shape, or, more advantageously, a stepped spiral shape. Whilst the packing elements pass through this spiral path, they are firstly opened or at least brought into a clearly defined, open position and then to each compartment or to each open packing element is supplied at least one printed product 4 to be packed (high capacity flow, arrow D) and inserted in the packing element. During the spiral further conveying as a function of the method variant and the drum equipment, further method steps of the packing method and at least a step in which the packing element is closed are performed, and, in the outlet area of the drum (end of arrow A, to the right in the drawing) the packed printed products 5, once again as a high capacity flow (arrow E) are removed from the drum. On removal from the drum the packing elements are at least closed to such an extent around the product to be packed that the product is sufficiently securely held therein for further conveying purposes. However, following the removal from the drum further closing steps can be performed, e.g. a lateral closing of the packing element.

Further method steps, which can be performed on packing elements 3 and printed products 4 located in the insertion compartments with already mentioned further means include e.g. folding-out a folded in part of the packing element, coating with adhesive one area of the packing element, wrapping round a projecting part of the packing element, pressing the wrapped round part against the pack, etc.

For the supply (arrow C, D) of the packing elements 3 and the printed products 4 into the drum and for the removal (arrow E) of the packed products 5 from the drum, it is e.g. possible to use apparatuses such as are described in the following patent publications of the present applicant: CH-668244 (or U.S. Pat. No. 4,801,132), EP-481914 (or U.S. Pat. No. 5,169,139), EP-341423 (or U.S. Pat. No. 4,981,291) or DE-2447336 (or U.S. Pat. No. 3,951,399).

Figure 2:
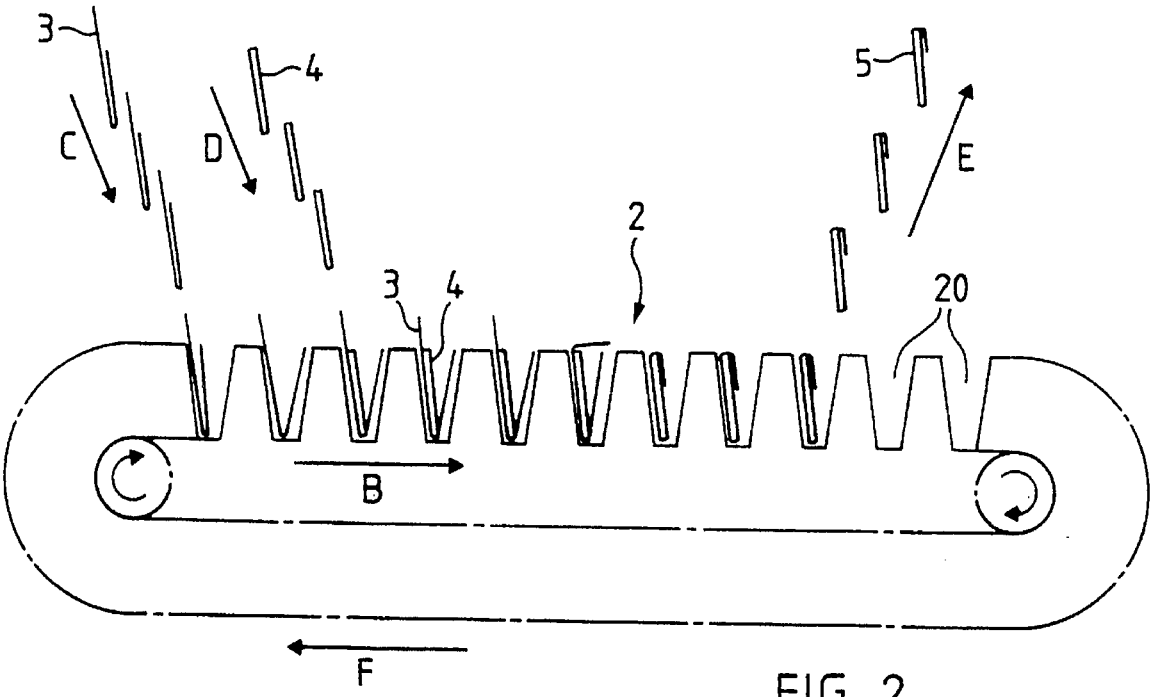
FIG. 2 shows a cross sectional view of a revolving packing system for packing printed products according to the invention.

FIG. 2 shows a revolving packing system 2 which also permits the performance of the method according to the invention. Such revolving systems functioning as insertion systems are e.g. described in the following patent publications: CH-669944 (or U.S. Pat. No. 4,743,005) or EP-346578 (or U.S. Pat. No. 5,104,108). Once again V-shaped insertion compartments 20 are used, which are moved continuously on a closed conveying path, e.g. in the described manner linked to a closed compartment chain and guided round two guide pulleys. The compartments are positioned transversely to their conveying direction (arrow B). The compartments of the revolving packing system, like the insertion compartments of the packing drum, can be much wider (perpendicular to the conveying direction) than the objects to be processed and are provided with internal conveying means for displacement (perpendicular to the paper plane) of the objects into the compartments and transversely to the conveying direction of the insertion compartments (arrow B). However, such conveying means can also be omitted, i.e. the packing elements and the printed products to be packed then have a substantially constant position in the compartments and the means for performing the individual method steps are advantageously arranged in fixed manner outside the compartments and perform a timed function synchronized with the conveying of the compartments. A variety of means for performing the method steps, which require a longer time, can be provided and can be moved over a specific section corresponding in each case to a specific compartment and then back to their original position again.

The description of the method according to the invention in conjunction with the packing drum can also be applied to the revolving packing system. Thus, the arrows B, C and D also indicate the conveying direction (B) of the insertion compartments during the performance of the packing method, the supply (C) of the packing elements 3, the supply (D) of the printed products 4 to be packed and the removal (E) of the packed products 5. A conveying of the packing elements and printed products in the insertion compartments (corresponding to arrow A in FIG. 1) is not shown, but is possible and namely in both directions transversely to the conveying direction B. Arrow F indicates the return side through which the insertion compartments are returned empty to the point of the packing element supply.

FIGS. 3 to 8 show different, exemplified variants of the packing method according to the invention. In each case only one packing element 3 and one printed product 4 to be packed are shown in successive stages of the packing method and as a finished packed product 5. Packed products which can be produced in further, similar method variants are also shown.

Figure 3:
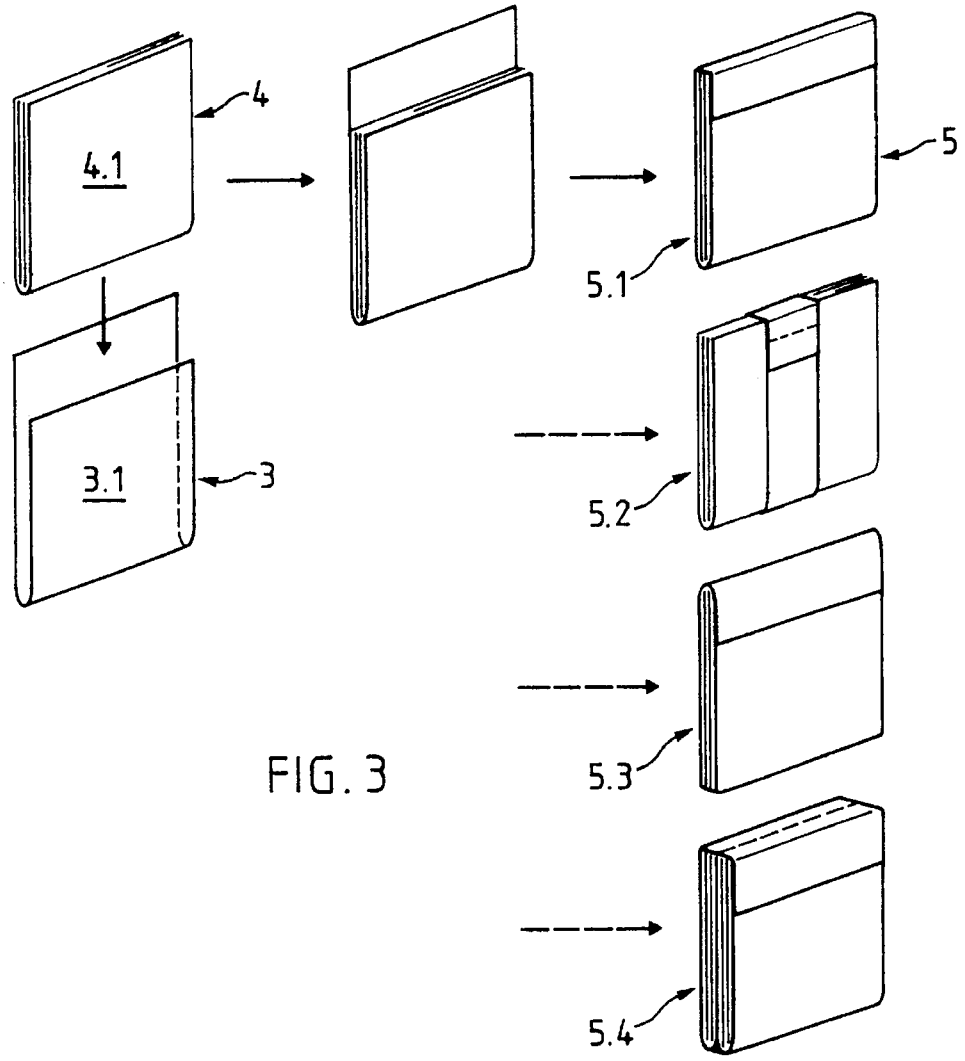
FIG. 3 shows various steps of one embodiment of the method according to the invention.

FIG. 3 shows a first, exemplified method variant. A printed product 4.1, e.g. a brochure, is inserted with the fold back, or spine, first, that is, facing forward, into a substantially equally wide packing element 3.1, which has a prefold, i.e. the packing element 3.1 is so folded, curved or bent that its two fold parts do not have the same extension transversely to the fold. For example the shorter part is of the same length or shorter than the product 4.1 to be packed, whereas the longer part is longer than the shorter part by more than the thickness of the product to be packed. The packing element 3.1 and the inserted printed product 4.1 are advantageously first aligned laterally with respect to one another and then the part of the packing element projecting over the inserted product is placed over the corresponding edge of the inserted printed product and pressed against the other side, e.g. after applying an adhesive thereto. The adhesive can also be applied beforehand to the packing element e.g. prior to the supply of the packing elements to the packing means. If the packing element 3.1 consists of a self-adhesive film, a pressing together is sufficient for closing the packing element. This leads to a packed product 5.1 in which the packing element covers the main faces of the printed product, but which is open at the sides.

The method variant of FIG. 3 can be further varied in the following way. The packing element is narrower than the printed product to be packed and surrounds the same in the finished pack in the form of a wrapping band (packing product 5.2). The printed product to be packed is inserted with the bloom (that is, the front, unbound edge) first in the packing element (packing product 5.3). Alternatively the back of the printed product is positioned transversely to the fold of the packing element. Several printed products, advantageously of the same size, are inserted with one another or successively into the packing element (packing product 5.4).

Figure 4:
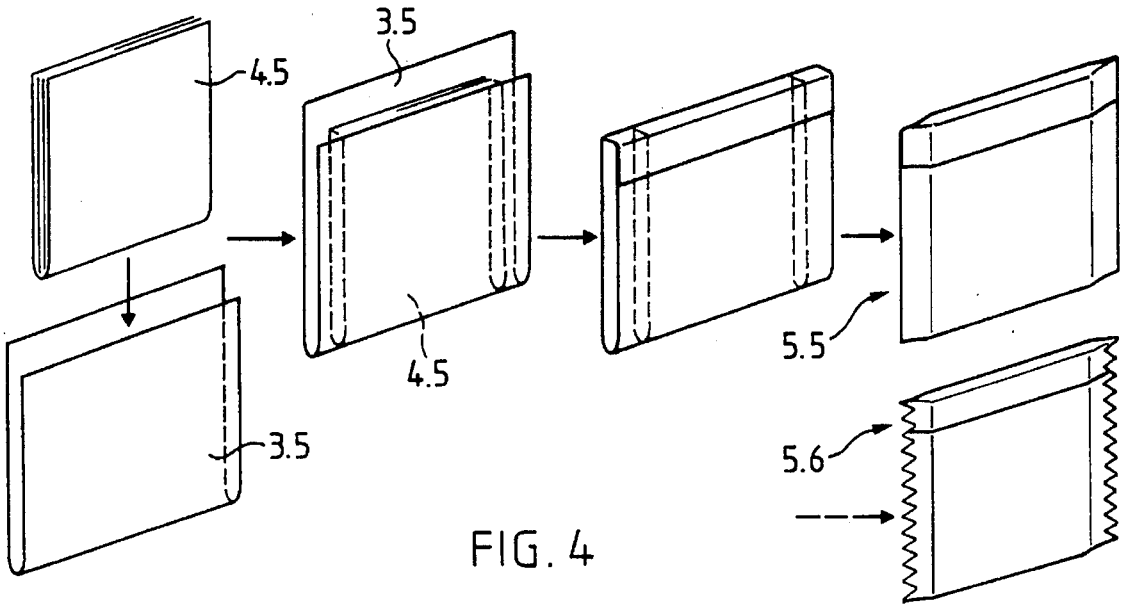
FIG. 4 is a view similar to FIG. 3 showing another embodiment of the method according to the invention.

FIG. 4 shows a further exemplified method variant. The packing element 3.5 is wider than the printed product 4.5 to be packed. The method takes place in the same way as the method according to FIG. 3 (without lateral alignment of the packing element and the printed product following insertion). However, there follows a step for laterally closing the packing element projecting laterally over the product to be packed. This step comprises e.g. activating an adhesive preapplied to lateral marginal areas of the packing element and pressing the marginal areas together (packing product 5.5). The lateral closure of the packing element can also be brought about by a deformation of the lateral marginal area of the packing element, such that a suitable packing material is so compressed that an adequate closure is obtained without an adhesive (packing product 5.6).

Figure 5:
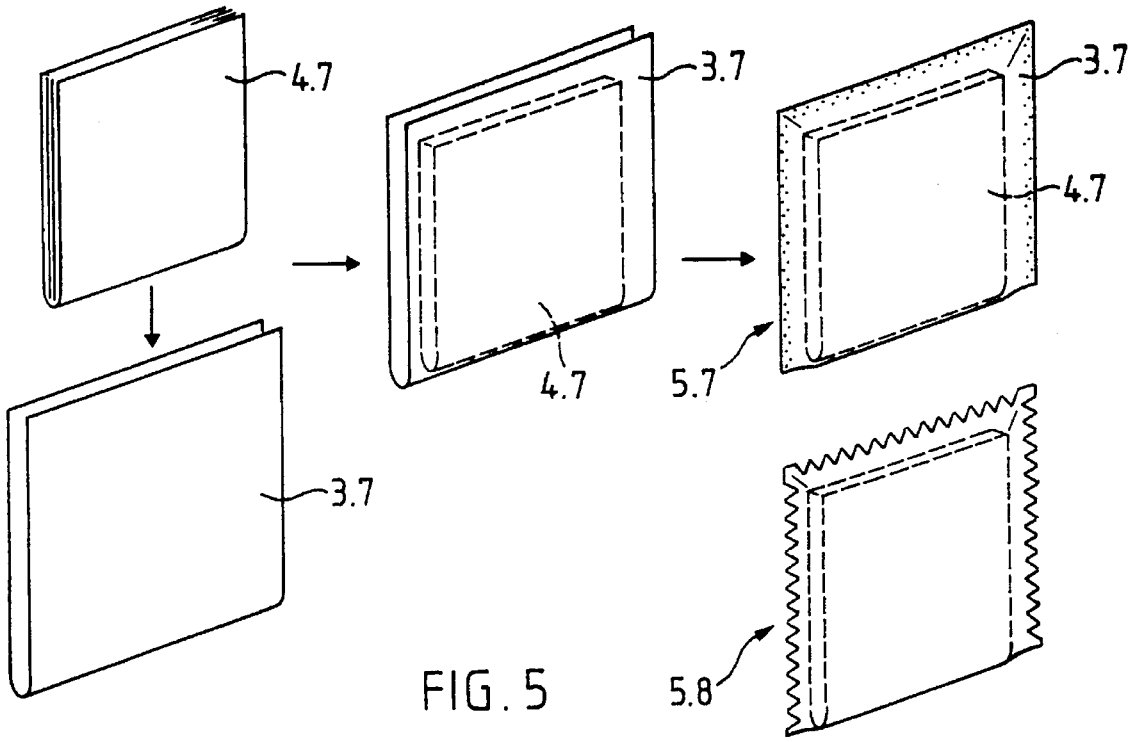
FIG. 5 is a view similar to FIG. 3 showing yet another embodiment of the method according to the invention.

FIG. 5 shows a further, exemplified method variant, in which the packing element 3.7, which is centrally folded or curved (no prefold) projects over the product 4.7 to be packed both parallel to its fold and transversely thereto. For closing the pack adhesion points applied beforehand to the marginal areas are, if necessary, activated and the marginal areas are pressed together (packing product 5.7). Adhesive can also be applied to the marginal areas of the packing element in the insertion compartments. Once again an edge deformation method can be used (packing product 5.8).

Figure 6:
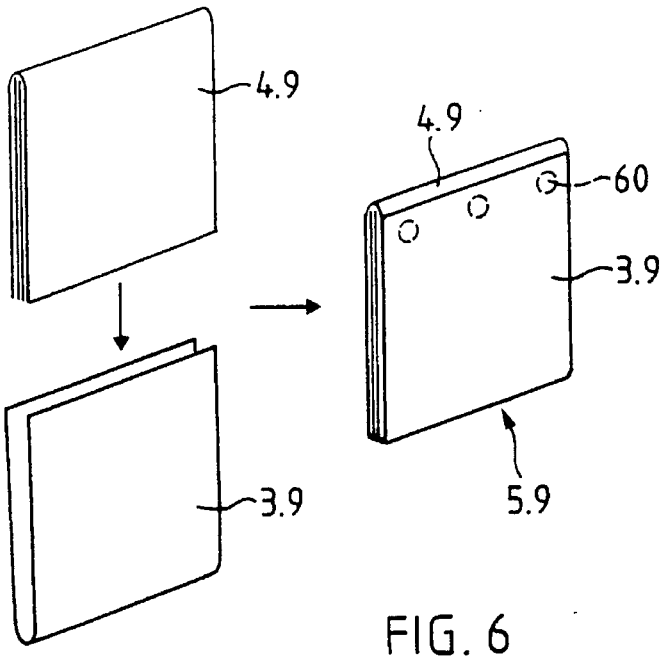
FIG. 6 is a view similar to FIG. 3 showing a further embodiment of the method according to the invention.

FIG. 6 shows a further, exemplified method variant. The packing element 3.9 used substantially corresponds to a double side of the product 4.9 to be packed. The product is inserted with the bloom first into the packing element and the latter is fixed by means of peel-off adhesion points 60 in the vicinity of the fold back of the printed product to be packed on the main faces thereof. This leads to a packing product 5.9, whose packing element is not in itself closed, but is closed by being fastened to the product to be packed.

Figure 7:
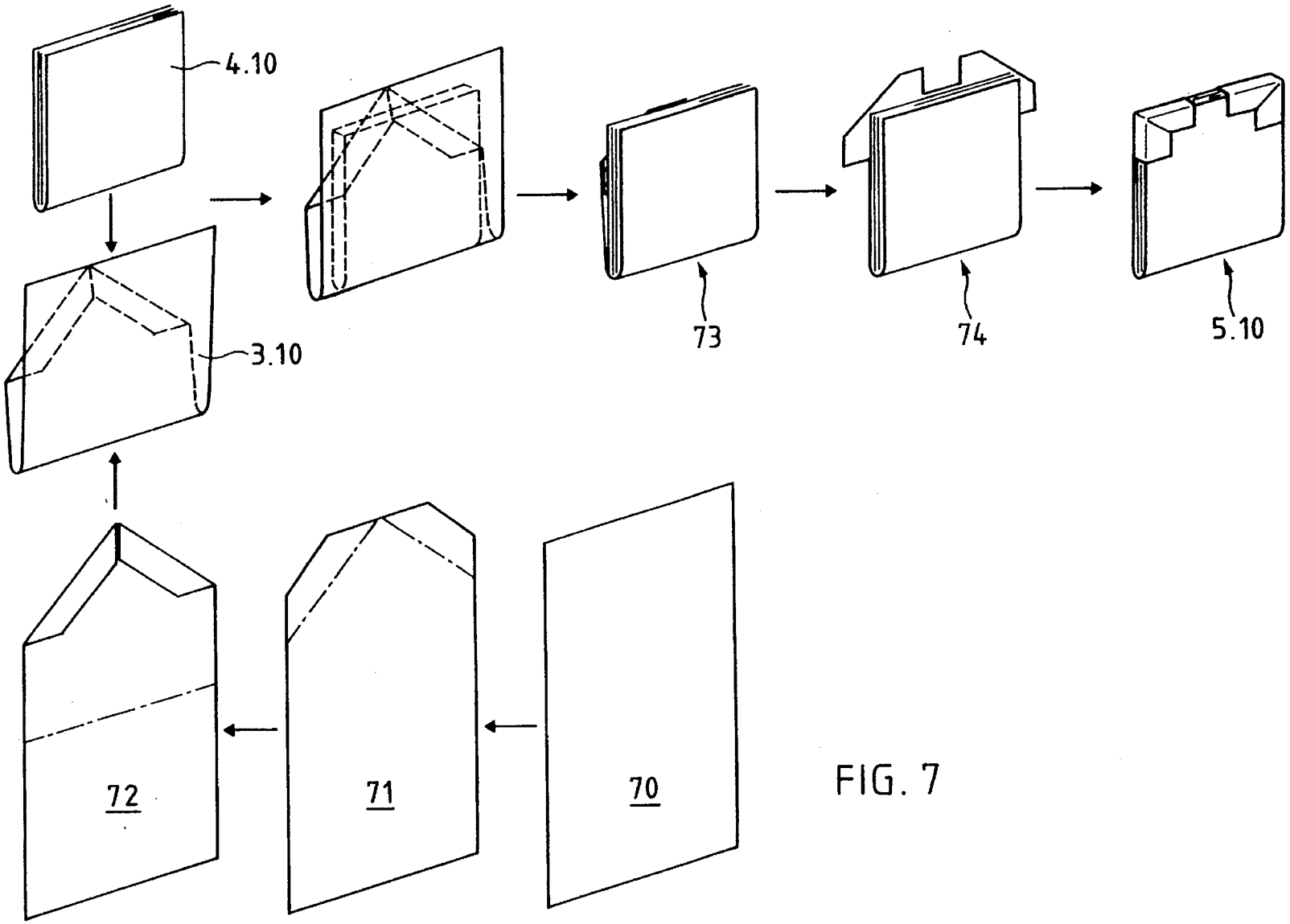
FIG. 7 is a view similar to FIG. 3 showing another embodiment of the method according to the invention.

FIG. 7 shows a further, exemplified method variant, where use is made of a packing element 3.10, which is not only prefolded or at least curved, but which has been pre-prepared by further preparatory steps. The packing element is formed from a sheet 70, which is centrally folded and when, not yet in a cut state, is as large or larger than the product 4.10 to be packed on all sides. From sheet 70 are cut off two corners (71) which are then folded in (72). The sheet is then centrally folded or curved and in this form is used as a packing element 3.10. The printed product 4.10 is inserted in the packing element 3.10 e.g. with the fold back first and both the packing element and the printed product are then trimmed together, e.g. laterally and in the vicinity of the bloom of the printed product (73). The folded in corners of the packing element are then folded out (74) and the parts of the packing element projecting over the product to be packed are placed over its edges and e.g. stuck to the opposite side. This gives an all-round, at least partly closed packing product 5.10.

FIG. 8 shows a further, exemplified method variant. In this case a packing element 3.11 is supplied, which is already stitched to the untrimmed printed product to be packed, but which is not yet cut. The production of such a printed product with stitched packing element in a combination method is e.g. described in Swiss patent 540816 (Grapha Holding). At least on one side, the packing element 3.11 has an inwardly folded prefold 80. The packing element 3.11 is so dimensioned and folded that the fold edge of the folded-in prefold 80 does not project over the printed product even in its trimmed state. The printed product with the stitched packing element is cut in the insertion compartment at least parallel to the packing element fold, such that the folded in prefold 80 is not contacted. The prefold 80 is then folded out or unfolded, placed over the printed product bloom and pressed onto the other side. This gives a packing product 5.11, which is very similar to the packing product 5.1 (FIG. 3), but in which the printed product is held with the aid of the stitching described above.

In the same way as described in conjunction with FIG. 8 with a packing element with a folded-in prefold, it is also possible to stitch a packing element 3.10 according to FIG. 7 to a printed product and then further process the same. Obviously, in both cases, the printed product with the stitched packing element can be supplied to the inventive method in an already trimmed state. In the printed product already stitched to the packing element can also be inserted one or more other printed products, namely between the packing element and the printed product stitched thereto or between the sides of the printed product.

The methods described in FIGS. 3 to 8 can be combined in numerous different ways and modified in an obvious manner so as to permit the production of a large number of further packed products.

FIGS. 9 to 14 show exemplified embodiments of means for performing the method steps on the packing elements located in the insertion compartments and/or on the printed products. If a packing drum (FIG. 1) or a revolving packing system (FIG. 2) is to be equipped in such a way that all the described method variants can be performed, it must be equipped with means for opening the packing element, with means for laterally aligning the packing element and the product to be packed, with means for trimming the packing element and the printed product, with means for folding out or opening the folded-in parts of the packing element, with means for applying adhesive to the packing element or printed product, with means for pressing together or deforming edge regions of the packing element, with means for placing the packing element over the edges of the product to be packed and with pressing means.

The means for performing the aforementioned method steps can be located on the insertion compartments. The above means can be quasi-stationary and the internal conveying means can guide the packing elements and/or the printed products to be packed into interaction with the above means, or they can act as a result of their own movement on the packing elements and/or printed products, which are stationary in the compartments. The means for performing the method steps can also he arranged in a fixed manner outside the insertion compartments in such a way that they can interact with the printed products and/or packing elements led into their vicinity by the movement of the insertion compartments.

The means for opening the packing element in the insertion compartment of a packing drum or for the clearly defined positioning of the already open packing element in the insertion compartment of a packing drum are known e.g. from DE-2447336 (or U.S. Pat. No. 3,951,399). The latter also discloses means for the lateral alignment of the packing element and the printed product to be packed. Corresponding adaptation thereof is necessary for insertion compartments of a revolving packing system. Further opening means are described in Swiss patents 644814 (or U.S. Pat. No. 4,398,710) or 644815 (or U.S. Pat. No. 4,420,146).

Means for trimming the packing element and printed product inserted therein are e.g. described in the following patents: EP-367715 (or U.S. Pat. No. 5,113,731), CH-583611 (or U.S. Pat. No. 4,038,893) or CH-668216.

FIG. 9 diagrammatically shows an exemplified means for folding out or opening a folded-in part of the packing element oriented parallel to its folded edge in an insertion compartment having (not shown), internal conveying means, e.g. in a packing drum. Only one wall 90 of the insertion compartment is shown. The rotation of the drum and the movement of the compartment content are indicated by the arrows B and A. The packing element 3 with the folded-in part 91 during its movement inside the insertion compartment (arrow A) is moved in an open state past a fold-out or unfold nose 92, in such a way that the latter engages between the folded in part 91 and the remainder of the packing element and unfolds the folded-in part. Folded-in parts which are positioned upstream and which are oblique to direction A, such as are e.g. shown in FIG. 7, can be unfolded with a similar nose. For a corresponding folded-in part positioned downstream it is necessary to provide a fold-out or unfold blade, as is shown in FIG. 10.

FIG. 10 shows an exemplified means for folding-out or unfolding folded-in parts of a packing element 3 in an insertion compartment without internal conveying means. Only one wall 100 of the insertion compartment is shown. The conveying direction B of the insertion compartment is at right angles to the paper plane. Laterally with respect to the insertion compartment 100 are arranged in fixed manner rotary fold up or unfold blades 101, 102, which are so synchronized with the movement of the insertion compartments that they engage below the folded-in parts 103, 104 of the packing element 3 and fold out or unfold the same. Blades of the type shown in FIG. 10 can also be provided in each insertion compartment (without internal conveying means) and are then correspondingly activated in a specific area of the conveying path (B) of the compartments.

Figure 11:
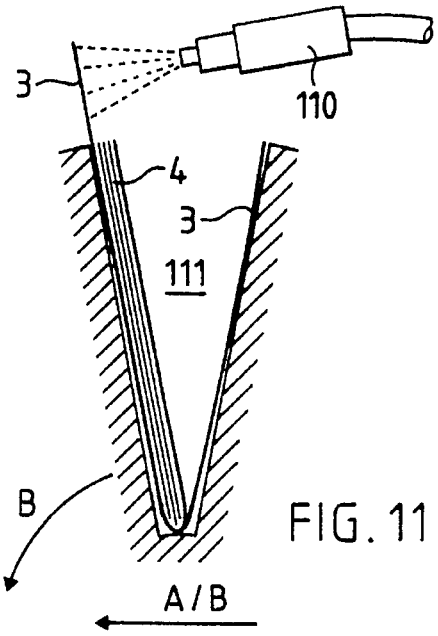
FIG. 11 is a schematic view of a means for applying adhesive to the packing element.

FIG. 11 very diagrammatically shows an exemplified means for applying adhesive to the packing element 3. The above means is constituted by a spraying unit 110, which is fixed outside the insertion compartments 111. As a function of the orientation of the spraying unit 110 parts of the packing element 3, which project over the printed product 4 to be packed, or the actual printed product 4, can be provided with adhesive.

Figure 12:
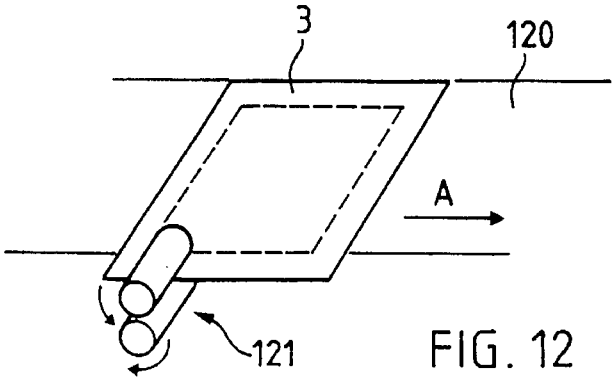
FIG. 12 is a perspective view of a means for pressing together and/or deforming marginal areas of the packing element.

FIG. 12 shows an exemplified embodiment of means for pressing together or deforming edge regions of the packing element (methods of FIGS. 4 and 5). It consists of a pair of rolls 121, which are pressed against one another and located on the insertion compartment (only one wall 120 thereof shown) and between which is passed the marginal region of the packing element 3 during its conveying inside the insertion compartment (arrow A). If the marginal region is to be simultaneously deformed, in place of the rolls use is made of meshing toothed rollers. The means for pressing together or deforming edge areas of packing elements, which do not cooperate with internal conveying means can be constituted by correspondingly structured clamping jaws movable against one another.

Figure 13:
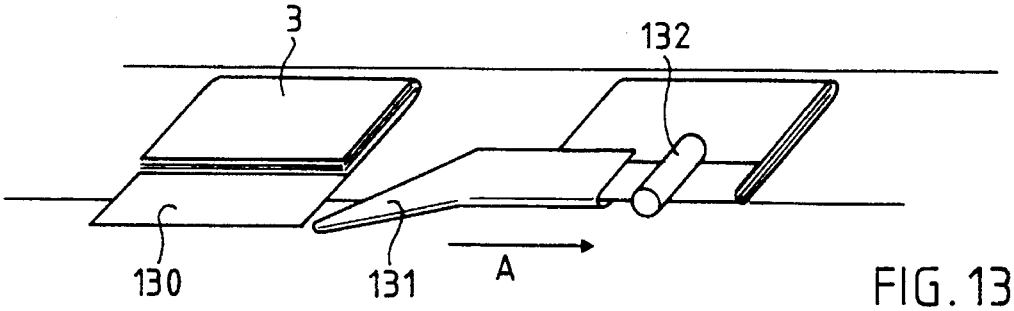
FIG. 13 is a perspective view of a fold nose and pressing roll for wrapping parts of the packing element over edges of the product insert.
Figure 14:
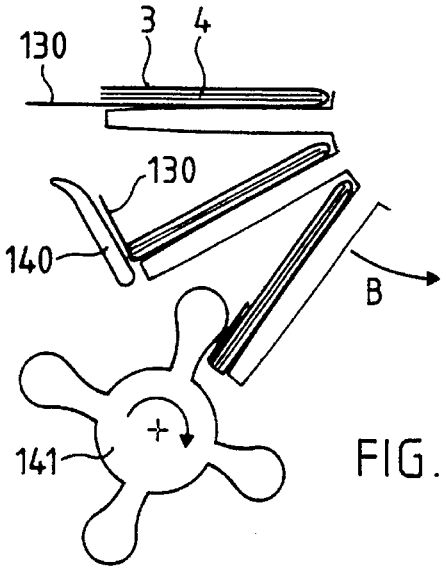
FIG. 14 is a perspective view of a wrapping template and a roller for wrapping parts of the packing element over edges of the product insert.

FIGS. 13 and 14 show exemplified embodiments of means for wrapping parts of the packing element over edges of the product to be packed and for pressing the parts onto the other side.

According to FIG. 13, during the conveying of the packing element inside the insertion compartment (arrow A) the prefold 130 of the packing element 3 is guided by a fold nose 131 and is then pressed by a pressing roll 132 against the packed printed product. The above means is usable in insertion compartments with internal conveying means for conveying the products in direction A.

According to FIG. 14 the packing element 3 and the printed product 4 to be packed are so held in the insertion compartment that the prefold 130 of the packing element projects from the same. The prefold is then moved past a wrapping template 140 through the movement of the insertion compartment in the direction B, in such a way that the prefold is placed over the corresponding edge of the printed product to be packed. With the aid of a correspondingly arranged star roller 141 driven in synchronized manner with the movement of the insertion compartments, the prefold is pressed against the packed printed product.

The means described and shown in conjunction with FIGS. 9 to 14 used for performing the individual steps of the method according to the invention constitute exemplified embodiments and it is also possible to use other known embodiments or embodiments derived from those described.

I claim:

1. A method for packing continuously conveyed printed products being conveyed one of individually and in groups by enveloping a product insert with a packing element, the product insert including one of a single product, a plurality of products supplied in succession and a group of products, the method comprising the steps of:

providing a plurality of substantially V-shaped insertion compartments being continuously conveyed in a compartment conveying direction along a closed conveying path;

providing a plurality of prefolded packing elements each having a fold in a substantially continuously conveyed stream of packing elements;

successively introducing into each insertion compartment a respective packing element such that the fold of the respective packing element is introduced into a corresponding insertion compartment first;

ensuring that each respective packing element is in an open position after the step of introducing thereby providing open packing elements;

inserting a product insert into each open packing element after the step of ensuring;

closing each open packing element at least partially over its corresponding product insert after the step of inserting thereby providing enveloped products; and removing each enveloped product from its corresponding insertion compartment after the step of closing.

2. The method according to claim 1, further including the steps of:

conveying each packing element and each product insert in the compartment conveying direction utilizing corresponding insertion compartments; and conveying each packing element and each product insert within corresponding insertion compartments in a direction transverse to the compartment conveying direction.

3. The method according to claim 1, wherein the step of providing a plurality of insertion compartments includes the step of providing a plurality of insertion compartments being conveyed so as to define a circular trajectory.

4. The method according to claim 1, wherein the step of providing a plurality of prefolded packing elements includes the step of providing a plurality of prefolded packing elements each having a first part on one side of the fold and a second part on another side of the fold and facing the first part, the first part projecting beyond the second part at least in one direction thereby providing at least one projecting part.

5. The method according to claim 4, wherein the step of closing each open packing element includes the steps of:

placing the at least one projecting part over adjacent edges of a corresponding product insert from one side of the corresponding product insert to another, opposite side of the corresponding product insert; and pressing the projecting part onto the opposite side of the corresponding product insert.

6. The method according to claim 4, wherein the step of providing a plurality of prefolded packing elements includes the step of providing a plurality of prefolded packing elements each having a projecting part projecting beyond a corresponding printed product at an edge of the corresponding printed product disposed opposite the fold of the packing element.

7. The method according to claim 4, wherein the step of providing a plurality of prefolded packing elements includes the step of folding-in a portion of each packing element, the method further comprising the step of folding-out the portion of each packing element after the step of inserting a product insert into the packing element.

8. The method according to claim 7, further including the step of trimming the product inserts and the packing elements on at least one edge thereof when the product inserts and the packing elements are in the insertion compartments.

9. The method according to claim 4, wherein:

the step of providing a plurality of prefolded packing elements includes the step of providing a plurality of prefolded packing elements each having a first part on one side of the fold and a second part on another side of the fold and facing the first part, the first part projecting and the second part projecting beyond a corresponding product insert at least in one direction thereby providing projecting parts; and the step of closing each open packing element includes the step of pressing the projecting parts together.

10. The method according to claim 9, wherein the step of closing each open packing element further includes the step of deforming the projecting parts simultaneously with the step of pressing the projecting parts together.

11. The method according to claim 9, further including the step of at least partially coating the projecting parts with adhesive prior to the step of pressing.

12. The method according to claim 1, wherein:

the step of inserting a product insert includes the step of inserting a product insert into each open packing element such that a bloom of the product insert is introduced into a corresponding packing element first; and the step of closing each open packing element includes the step of fastening a part of each packing element to a corresponding product insert.

13. The method according to claim 1, further including the steps of:

inserting an additional product into each packing element prior to closing the packing element; and stitching each packing element to a corresponding product insert prior to the step of inserting an additional product.

14. A device for packing continuously conveyed printed products being conveyed one of individually and in groups by enveloping a product insert with a packing element, the product insert including one of a single product, a plurality of products supplied in succession and a group of products, the device comprising:

a conveying device including a plurality of substantially V-shaped insertion compartments being continuously conveyed in a compartment conveying direction along a closed conveying path;

means disposed adjacent the conveying device for supplying a plurality of prefolded packing elements in a substantially continuously conveyed stream of packing elements, each of the packing elements having a fold;

means disposed adjacent the means for supplying for successively introducing into each insertion compartment a respective packing element such that the fold of the respective packing element is introduced into a corresponding insertion compartment first;

means disposed, relative to the compartment conveying direction, downstream of the means for introducing for ensuring that each respective packing element is in an open position thereby providing open packing elements;

means disposed downstream of the means for ensuring for inserting a product insert into each open packing element;

means disposed downstream of the means for inserting for closing each open packing element at least partially over its corresponding product insert thereby providing enveloped products; and means disposed downstream of the means for closing for removing each enveloped product from its corresponding insertion compartment.

15. The device according to claim 14, wherein the insertion compartments are oriented transversely with respect to the compartment conveying direction.

16. The device according to claim 14, further comprising internal conveying means disposed in each insertion compartment for conveying the packing elements and the product inserts within each insertion compartment transversely to the compartment conveying direction.

17. The device according to claim 14, wherein the conveying device further comprises a compartment support including one of a packing drum and a revolving packing system, the insertion compartments being disposed on the compartment support.

18. The device according to claim 14, further comprising additional means disposed one of in the insertion compartments and adjacent the insertion compartments, the additional means including at least one of:

means for laterally orienting the packing elements and the product inserts with respect to one another;

means for trimming the product inserts and the packing elements on at least one edge thereof;

means for unfolding folded-in parts of the packing elements;

means for applying adhesive to one of the packing elements and the product inserts;

means for performing one of pressing together and deforming projecting parts of the packing elements;

means for deforming projecting parts of the packing elements;

means for wrapping each packing element over edges of the product insert; and means for pressing on projecting parts of the packing element.

19. The device according to claim 18, wherein the additional means are one of movable within the insertion compartments relative to substantially stationary packing elements and product inserts, disposed within the insertion compartments such that packing elements and product inserts are movable relative thereto and fixed adjacent the insertion compartments such that the insertion compartments are movable relative thereto.

20. The device according to claim 18, wherein the additional means include the means for unfolding folded-in parts of the packing elements, the means for unfolding comprising one of an unfolding nose disposed in each insertion compartment and an unfolding blade disposed adjacent each insertion compartment.

21. The device according to claim 18, wherein the additional means include the means for applying adhesive, the means for applying adhesive comprising a spraying unit fixed with respect to the insertion compartments.

22. The device according to claim 18, wherein the additional means include the means for performing, the means for performing comprising one of a pair of cooperating pressing rollers, a pair of cooperating meshing toothed rollers and a pair of cooperating clamping jaws movable against one another.

23. The device according to claim 18, wherein the additional means include the means for wrapping, the means for wrapping comprising one of a folding nose disposed in at least one insertion compartment and a wrapping template fixed with respect to the insertion compartments.

24. The device according to claim 18, wherein the additional means include the means for pressing on projecting parts, the means for pressing on projecting parts comprising at least one of a pressing roller disposed in at least one insertion compartment and a fixed star roller disposed adjacent the insertion compartments.

* * * * *